US006601928B1

(12) United States Patent
Kortman et al.

(10) Patent No.: US 6,601,928 B1
(45) Date of Patent: Aug. 5, 2003

(54) INDUSTRIAL COMPONENT HOLDER ASSEMBLY AND RACK

(75) Inventors: Calvin J. Kortman, Holland, MI (US); Mark A. Kortman, Holland, MI (US); Joyce E. Kortman, Holland, MI (US)

(73) Assignee: Production Assembly Service Inc., Holland, MI (US)

( * ) Notice: Subject to any disclaimer, the term of this patent is extended or adjusted under 35 U.S.C. 154(b) by 0 days.

(21) Appl. No.: 09/838,985

(22) Filed: Apr. 20, 2001

Related U.S. Application Data

(63) Continuation-in-part of application No. 09/536,662, filed on Mar. 27, 2000, now Pat. No. 6,305,764.

(51) Int. Cl.[7] ..... E04H 15/04

(52) U.S. Cl. ..... 312/3; 211/195; 108/162; 312/5

(58) Field of Search ..... 312/3, 4, 5, 6, 312/258, 265.1, 265.4, 351, 297; 211/194, 195, 201; 190/13 R; 108/60, 162, 172, 53.1; 248/95, 97, 99

(56) References Cited

U.S. PATENT DOCUMENTS

| | | | | |
|---|---|---|---|---|
| 937,659 | A | | 10/1909 | Todd |
| 1,216,250 | A | | 2/1917 | Bittle |
| 1,225,607 | A | | 5/1917 | Ford et al. |
| 1,414,858 | A | | 5/1922 | Brown |
| 1,421,515 | A | | 7/1922 | McKnight |
| 1,480,537 | A | | 1/1924 | Heller |
| 1,640,083 | A | | 8/1927 | Ladd |
| 1,691,621 | A | | 11/1928 | Young |
| 3,275,394 | A | | 9/1966 | Massinger |
| 3,338,423 | A | | 8/1967 | Wellman, Jr. |
| 3,465,891 | A | | 9/1969 | De Rose |
| 3,532,153 | A | | 10/1970 | D'Anka |
| 3,586,410 | A | | 6/1971 | Barrow |
| 3,630,387 | A | | 12/1971 | Wehner |
| 3,669,276 | A | | 6/1972 | Woods |
| 3,729,242 | A | | 4/1973 | Barney |
| 3,732,978 | A | | 5/1973 | Reader |
| 3,760,943 | A | | 9/1973 | Reader |
| 3,912,086 | A | | 10/1975 | de Bruyn |
| 4,217,012 | A | | 8/1980 | Klaus |
| 4,249,663 | A | | 2/1981 | Hewlett |
| 4,403,701 | A | | 9/1983 | Corcoran |
| 4,527,694 | A | | 7/1985 | Bolt et al. |
| 4,653,818 | A | | 3/1987 | DeBruyn |
| 4,773,547 | A | * | 9/1988 | Bell ..... 211/194 |
| 4,907,706 | A | | 3/1990 | Henderson |
| 4,934,636 | A | * | 6/1990 | Orlosky et al. ..... 211/194 |
| 4,988,006 | A | | 1/1991 | Lundin |
| 4,998,630 | A | | 3/1991 | Schwartz |
| 5,031,782 | A | | 7/1991 | Minervini |
| 5,154,305 | A | | 10/1992 | Whitney |
| 5,358,126 | A | | 10/1994 | Jones et al. |
| 5,437,379 | A | | 8/1995 | Wolf et al. |
| 5,452,811 | A | | 9/1995 | Taravella et al. |
| 5,590,940 | A | | 1/1997 | Richard |
| 5,924,577 | A | | 7/1999 | Gessert |
| 6,022,033 | A | | 2/2000 | Landesman et al. |
| 6,056,382 | A | | 5/2000 | Arad |
| 6,073,786 | A | | 6/2000 | McCorkle, Jr. |
| 6,305,764 | B1 | * | 10/2001 | Kortman et al. ..... 312/3 |
| 6,464,092 | B1 | * | 10/2002 | Kortman et al. ..... 211/194 |

* cited by examiner

*Primary Examiner*—Janet M. Wilkens
(74) *Attorney, Agent, or Firm*—Van Dyke, Gardner, Linn & Burkhart, LLP

(57) ABSTRACT

A rack for holding industrial components, such as vehicle components, including class A components, includes a rigid frame and a flexible frame which is positionable in the rigid frame and which is preferably collapsible. The flexible frame is adapted to support a plurality of industrial components in at least a spaced vertical arrangement. Preferably, the flexible frame includes a plurality of flexible side members and a plurality of substantially rigid shelf elements which is mounted between.

21 Claims, 7 Drawing Sheets

INDUSTRIAL COMPONENT HOLDER ASSEMBLY AND RACK

This application is a continuation-in-part of application, Ser. No. 09/536,662, filed Mar. 27, 2000, now U.S. Pat. No. 6,305,764 which is incorporated by reference herein.

TECHNICAL FIELD AND BACKGROUND OF THE INVENTION

The present invention generally relates to a rack assembly for holding components and, more particularly, to a rack assembly for holding industrial components in such a manner to provide quick access to the industrial components while preserving the integrity of each component.

When assembling products, such as a vehicle, a computer, furniture or the like, assembly line workers need quick access to the pre-assembled parts or components that are to be installed in or on the product so that the assembly line flow is unimpeded by the flow of parts. Small parts are typically stored en masse in totes and are positioned adjacent the assembly line for easy access by the assembly line worker. More recently, an improved industrial component rack, which is described in copending application entitled INDUSTRIAL COMPONENT RACK ASSEMBLY, filed by Production Assembly, Inc. of Holland, Mich., on Mar. 23, 2000, the disclosure of which is hereby incorporated by reference in its entirety, individually supports each component in a manner to eliminate contact between the components and, furthermore, supports the components in a carrier assembly which is movably mounted to a rack frame. The frame provides protection to the components in the carrier assembly when the carrier assembly is retracted within the frame and supports the carrier assembly when it is extended from the frame, which permits easy access to all the components in the carrier assembly.

Large parts, on the other hand, are typically supported in a rack frame by a column of vertically spaced flexible support shelves. The shelves comprise fabric webs which extend between a pair of fabric panels which form sides of the column. In order to maintain the spacing between the sides of the vertical storage columns, stiffeners are often incorporated into the flexible support shelves. However, the fabric panels do not provide sufficient protection to the component parts supported on the support shelves. When the racks are moved, these fabric columns shift in the frame permitting impact between the components supported in adjacent columns. Though the impact is somewhat absorbed by the sides of the columns, with larger parts the amount of impact absorbed by the fabric sides may not be sufficient. Furthermore, each storage column requires extensive stitching to assemble and mechanical mounting to the support frame, which mechanical mounting increases the cost and weight of the overall rack assembly.

In addition, when storing vehicle components, such as Class A vehicle components, manufactures often require components to be covered until they are installed on or in the vehicle to protect the components from airborne debris such as dust, fumes, or the like, which could scratch, discolor or otherwise damage the components. Typically, canvas or other material covers are mounted to the exterior of the rack framework which require lifting for access to the components held within the rack. As these rack assemblies are designed for stacking and, further, for lifting by a fork lift or other mechanical means, these covers are subject to damage and require frequent replacement.

Consequently, there is a need for a storage system which will provide a cost efficient method for holding a plurality of larger pre-assembled industrial components, such as computer components, furniture components, vehicle components, including Class A components, while providing easy access to each individual component for installation. Further, there is a need for an adjustable storage system, which can modified at the assembly plant. In addition, there is a need for a storage system that will provide the above advantages and, further, will protect the components from dust and debris all in a manner that will permit the storage system to be stacked and handled without damage to the individual components comprising the storage system.

SUMMARY OF THE INVENTION

According to the present invention, a rack assembly for holding a plurality of industrial components is provided that holds components in such a manner that the components are readily available for installation in an assembly line and, further, which are protected from damage. In preferred form, the rack assembly individually supports each component to essentially eliminate contact between the components and, furthermore, supports the components in a collapsible frame which provides for multiple configurations of support shelves. Furthermore, the collapsible frame includes a plurality of supports for suspending the collapsible frame from a rigid rack. While the collapsible frame is positioned interiorly of the rack, the open end of the collapsible frame and the open side of the frame permits access to the components within the flexible frame as needed.

In one form of the invention, a rack for holding industrial components includes a rigid frame and a collapsible frame. The collapsible frame is positionable in the rigid frame and is supported by the rigid frame. The collapsible frame is adapted to support a plurality of industrial components in a vertically spaced arrangement with the industrial components accessible through an open side of the rigid frame.

In one aspect, the collapsible frame includes a plurality of side members and a plurality of shelves extending between the side members. In further aspects, the shelves comprise substantially rigid shelves, such as formed by plastic panels, while the side members optionally comprise flexible side members. For example, the shelves may be arranged in a plurality of rows and columns. In other aspects, the side members comprise fabric panels. The shelves are secured between respective side members by fasteners, for example, by staples or the like.

According to another form of the invention, a rack for holding industrial components includes a rigid frame and a flexible frame having a plurality of support surfaces for supporting a plurality of industrial components. The rigid frame includes a plurality of upper horizontal members and a plurality of lower horizontal members which are interconnected by a plurality of vertical members to thereby form an open sided frame. The flexible frame includes a plurality of side members and a plurality of shelf elements which are secured between respective side members. In addition, the frame includes a plurality of supports to suspend the flexible frame from the rigid frame. The shelf elements are open on at least one end to provide access to components supported in the flexible frame In one aspect, the shelf elements comprise substantial rigid panels, for example plastic panels including corrugated plastic panels. The side members are flexible to thereby permit the flexible frame to collapse. For example, the side members may comprise fabric panels or the like.

These and other advantages, purposes and objects will be more apparent from a review of the drawings and tedescription which follows.

DETAILED DESCRIPTION OF THE PREFERRED EMBODIMENTS

Figure 1:
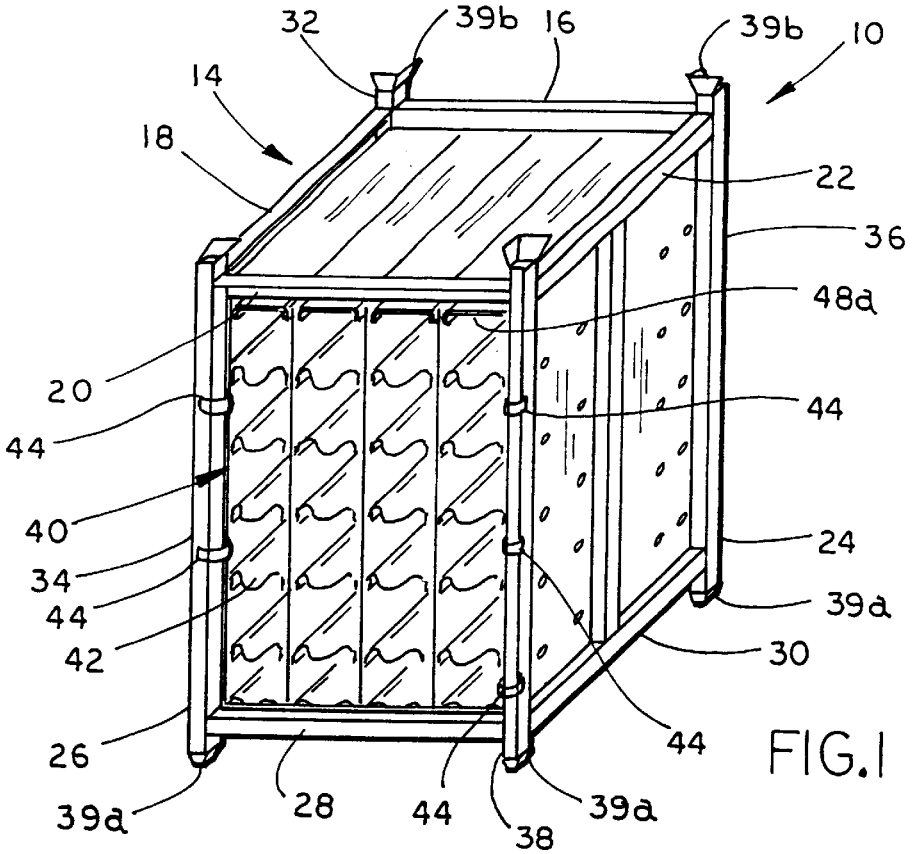
FIG. 1 is a perspective view of a rack assembly of the present invention.

Referring to FIG. 1, the numeral 10 generally designates an industrial component rack of the present invention. Rack 10 includes a collapsible, self-supporting frame assembly 40 which is adapted to support a plurality of larger industrial components, such moldings for vehicles, vehicle window assemblies, interior trim components, or the like. Though lightweight, frame assembly 40 provides enhanced protection to the components supported by the assembly and, further, can be quickly and easily inserted into and removed from a conventional rack without tools or heavy mechanical mounting hardware. Furthermore, as will be more fully described in reference to the second and third embodiments, the frame assembly provides space between the frame assembly and the rack to permit a protective cover and cover mounting hardware to be mounted to the rack inwardly of the rack framework, thus providing a cover and cover mounting hardware that is not subject to damage when the rack is stacked or moved by mechanical means.

As best seen in FIG. 1, rack 10 includes a rigid frame 14 which is defined by a first set of horizontally arranged members 16, 18, 20, and 22 and a second set of horizontally arranged frame members 24, 26, 28, and 30, which are interconnected by vertical frame members 32, 34, 36, and 38, for example by welding, riveting, bolting or the like. Optionally, mounted to the ends of vertical frame members 32, 34, 36, and 38 are bearing assemblies 39*a,* such as wheels or rollers, so that rack 10 can be easily moved to the assembly line to deliver parts and moved away from the assembly line to replenish the supply of parts. In addition, vertical frame members 32, 34, 36, and 38 include guide members 39*b* for guiding another rack onto rack 10 for stacking and, further, which provide lateral support to a rack which is stacked on top of rack 10.

Positioned in frame 14 is collapsible, flexible frame assembly 40. As best seen in FIG. 2A, frame assembly 40 includes a plurality of flexible support surfaces 42 for supporting industrial components. Preferably, support surfaces 42 are arranged and sized to individually support the components and to protect the components from contact with each other or contact with other hard surface, such as frame 14. Alternately, support surfaces 42 can be arranged and sized to hold more than one component as would be understood by those skilled in the art.

Figure 2B:
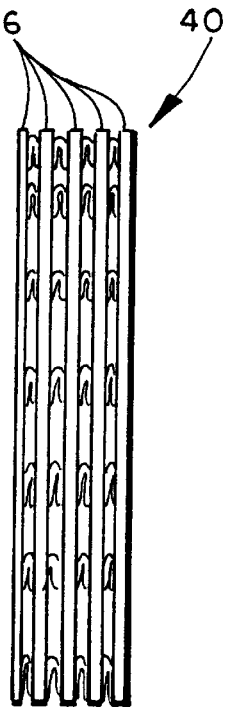
FIG. 2B is a front elevation view of the insert of FIG. 2 illustrating the insert compressed into a compact configuration.
Figure 2A:
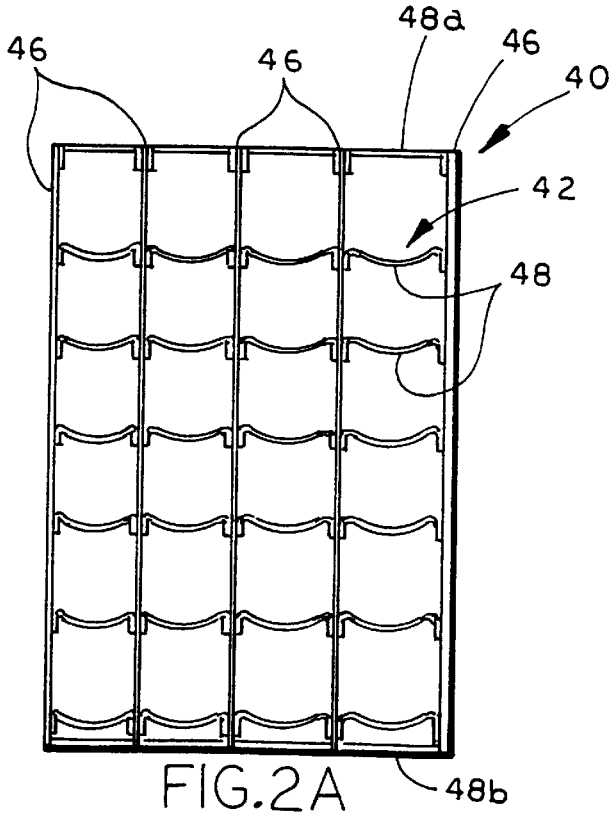
FIG. 2A is a front elevation view of a collapsible, self-supporting frame insert of the rack assembly of FIG. 1.

Flexible frame 40 can be collapsed as shown in FIG. 2B, for easy insertion into frame 14. Once flexible frame 40 is positioned in frame 14, it can then be expanded and optionally secured to vertical frame members 32, 34, 36, and 38 by spring clips 44 or the like, or to intermediate vertical frame members 31 which provide additional reinforcement to frame 14. Alternately, flexible frame 40 can be releasably secured to vertical frame members 32, 34, 36, and 38 by fasteners or the like may be mounted on projecting hooks or studs or the like which project inwardly from the vertical frame members. As will be more fully described below, each shelf 42 gently cradles the components and protects the components from contact with any hard surfaces.

Rack 10 is particularly suitable for holding and supporting a plurality of industrial components, such as vehicle components, in an assembly line and, more particularly, suitable for holding and supporting Class A vehicle components which are required to be free of scratches or mars of any sort before installation into a vehicle while permitting quick access to the components.

Referring again to FIG. 2A, flexible frame 40 includes a plurality of side members 46 which are substantially rigid but preferably formed from a lightweight, impact absorbing material, such as plastic. Side members 46 provide improved part protection as compared to the conventional fabric shelving currently available. In most preferred form, side members 46 comprise corrugated or fluted plastic panels which provide sufficient stiffness to form a self-supporting structure while providing a lightweight collapsible frame which can be easily inserted into and removed from rigid frame 14. As noted above, side members 46 are preferably impact absorbent and, further, may be formed from recycled material. In addition, sides 46 may comprise laminated panels, such as metal panels, for example aluminum panels, with a layer of impact absorbing material, such as a microfoam layer, to provide enhanced impact absorbing characteristics to the metal panel.

Figure 4:
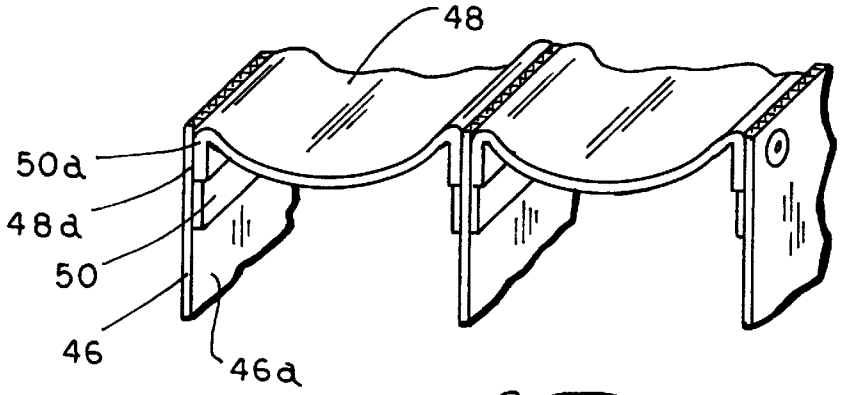
FIG. 4 is an enlarged fragmentary perspective view of a pair of shelves of the flexible frame insert of FIG. 2.

Shelves 42 are formed from elongate panels 48 of a flexible substrate, such as fabric, including for example canvas, vinyl, including vinyl coated fabric, leather, or the like. Referring to FIG. 4, panels 48 are mounted to side members 46 by an elongate mounting plate 50. The free edge 48*a* of panel 48 extends over an upper free edge 50*a* of mounting plate 50, which is then fastened to side panel 46, for example by fasteners or the like. In this manner, mounting plate 50 protects elongate panel 48 from tearing and, further, compresses free edge 48*a* against surface 46*a* of side member 46 to thus frictionally hold panel 48 in place. Preferably, shelves 42 extend the full length of frame 14 from one side of frame 14 to the other side of frame 14, but it should be understood that intermediate webbing may be provided to define compartments with the compartments being accessible from the opposed sides of the frame 14. In addition, because shelves 42 are formed from a flexible substrate, shelves 42 may be configured to form cradles so that the components are also laterally held by the respective shelf. The depth of the cradle depends on the spacing of the side members—the closer spaced the side members the deeper the cradle. Optionally, the upper and lower webs 48*a* and 48*b* may be sized such that when they are pulled straight by side members 46 so that they are substantially planar (FIG. 2A), the remaining webs 48 are properly spaced for a given part. It should be understood that the upper and lower webs 48*a* and 48*b* may be adjustable to accommodate different cradle depths for different components. In this manner, when the manufacturer places the flexible frame in the rigid frame, the flatness of the upper and lower webs will provide a guide or check that the flexible frame is properly positioned for a given application.

Figure 6:
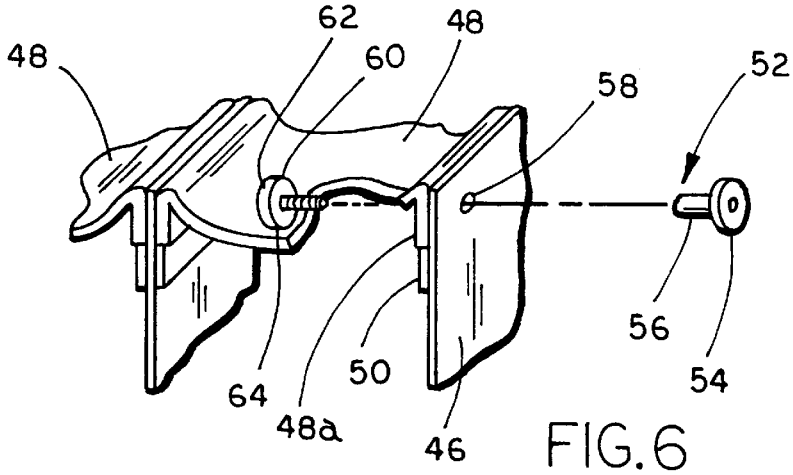
FIG 6 is a partial exploded perspective view of the mounting of the shelf to the side member of FIG. 4.

Referring to FIG. 6, a preferred form of fastener 52 includes a female connector with a mounting flange 54 and a projecting cylindrical body 56 which is positioned in an opening 58 provided in side member 46 and which extends through free edge 48*a* of elongate panel 48 and through mounting plate 50. Inserted into cylindrical body 56 is a male connector 60 which includes a mounting flange 62 and a projecting pin 64. Preferably, pin 64 and inner surface of cylindrical body 56 are threaded to provide a secure connection between pin 64 and body 56. In addition, snaps may be used to secure strip 42 to side members 46. By providing these types of fasteners, flexible frame assembly 40 can be adjusted on site and, further, individual shelves can be removed for repair or replacement.

Figure 3:
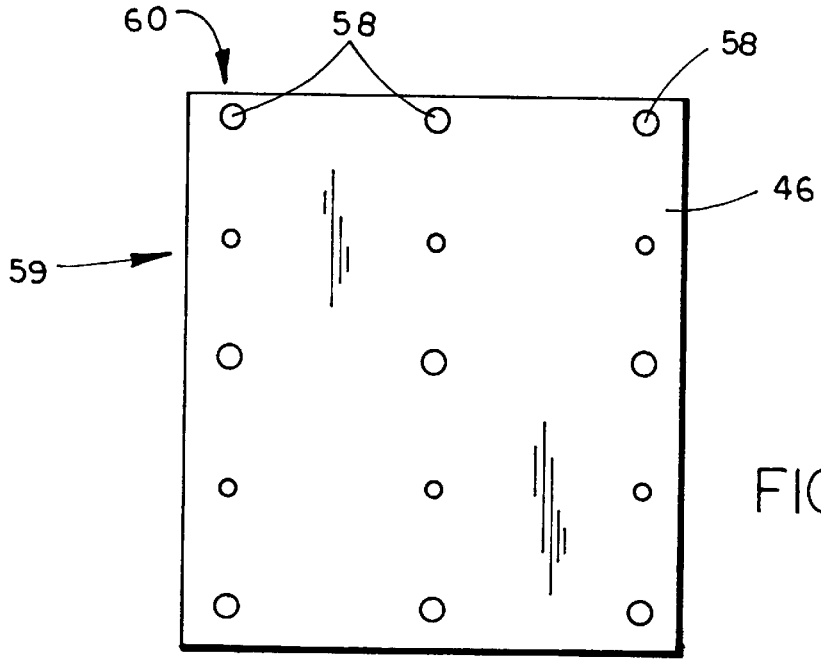
FIG. 3 is a side elevation of the frame insert of FIG. 2.

Referring to FIG. 3, side members 46 includes a plurality of mounting holes 58. Preferably, mounting holes 58 are predrilled or preformed and permit shelves 42 to be repositioned and adjusted as desired. It should be understood, that other fastening arrangements may be used to secure panels 48 to side members 46. In addition, free edge portions 48*a* of elongate panels 48 may be adhered to side members 46 by an adhesive or the like. While not providing the same adjustment feature as fasteners or snaps, stitches, adhesive, or welds may be used, which will provide for a strong connection between panels 48 and side members 46.

Figure 5:
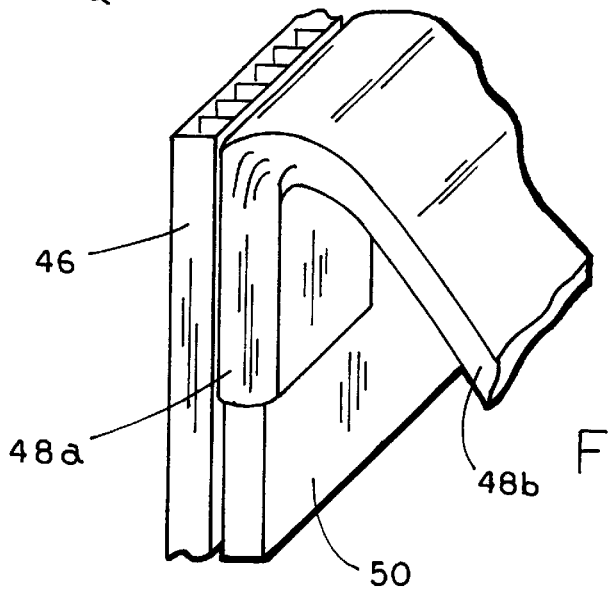
FIG. 5 is an enlarged fragmentary perspective view of the mounting of a shelf to a side member of the flexible frame insert of FIG. 2.

Referring to FIG. 5, panels 48 include a second free edge 48*b* which is generally orthogonal to free edge 48*a* which defines the free edge of shelves 42. Free edge 48*b* may be folded over to stiffen the edges of shelves 42 and, further, to provide an increased resistance to tearing or the like.

As noted above, side members 46 preferably comprise lightweight and yet substantially rigid panel members and may comprise, in addition to plastic panels and metal panels, wood or a composite panel, such as plastic coated cardboard or the like. In addition, as note above, preferably each side member 46 includes predrilled holes 48 in a plurality of rows 59 and columns 60. In this manner, side members 46 provide for adjustment the respective shelves 42.

Figure 7:
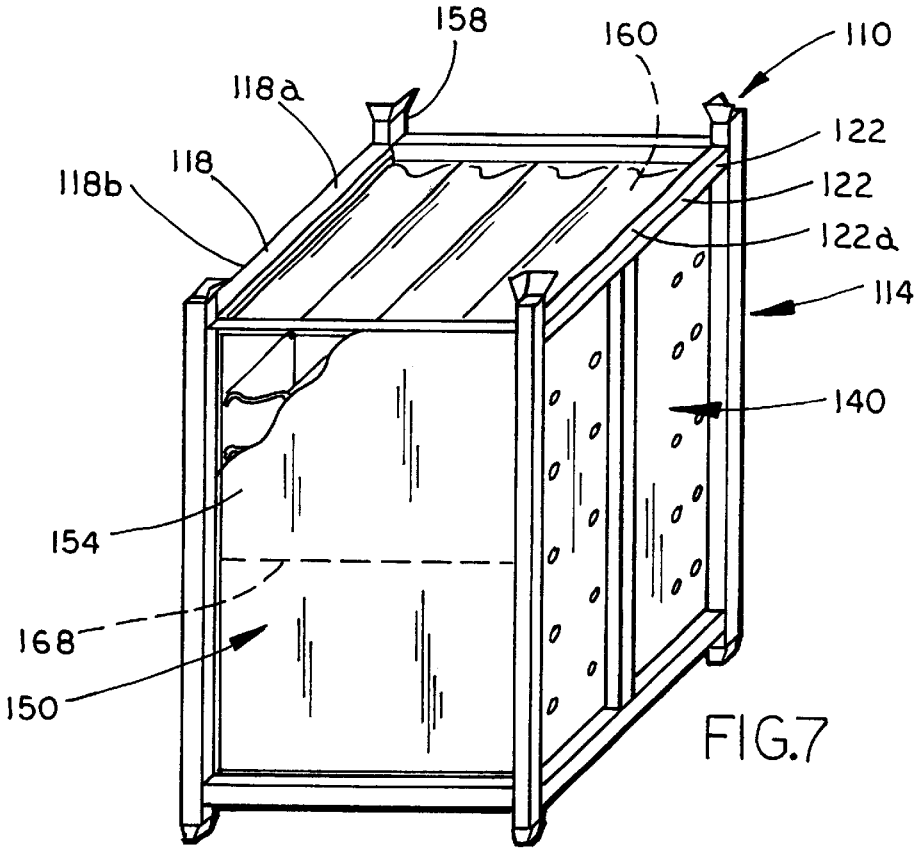
FIG. 7 is a perspective view of a second embodiment of the rack assembly of the present invention incorporating a retractable cover.

Referring to FIG. 7, a second embodiment 110 of the industrial component rack of the present invention is illustrated. Rack 110 includes a frame 114 similar to frame 14 and a collapsible insert frame 140, which is of similar construction to collapsible frame 40 of the first embodiment. Preferably, collapsible frame 140 is slightly undersized to provide a gap between collapsible frame 140 and frame 114 to accommodate a protective cover 150 and its respective mounting hardware 152 within frame 114. Cover 150 is preferably movable between a closed position (shown in FIG. 7), wherein cover 150 protects the industrial components positioned in collapsible frame 140 and an open position (FIG. 8) wherein cover 150 is retracted within frame 114 to permit access to the components supported on shelves 142. Cover 150 preferably comprises a solid panel member but may comprise a composite panel formed from two or more hinged panels or a frame with one or more solid but lightweight panels supported by the frame. For example, when incorporating a frame, the panels may comprise plastic or even fabric panels. Preferably, cover 150 is impervious to airborne contaminants so that when cover 150 is moved to its closed position, the components within collapsible frame 140 are protected.

Figure 9:
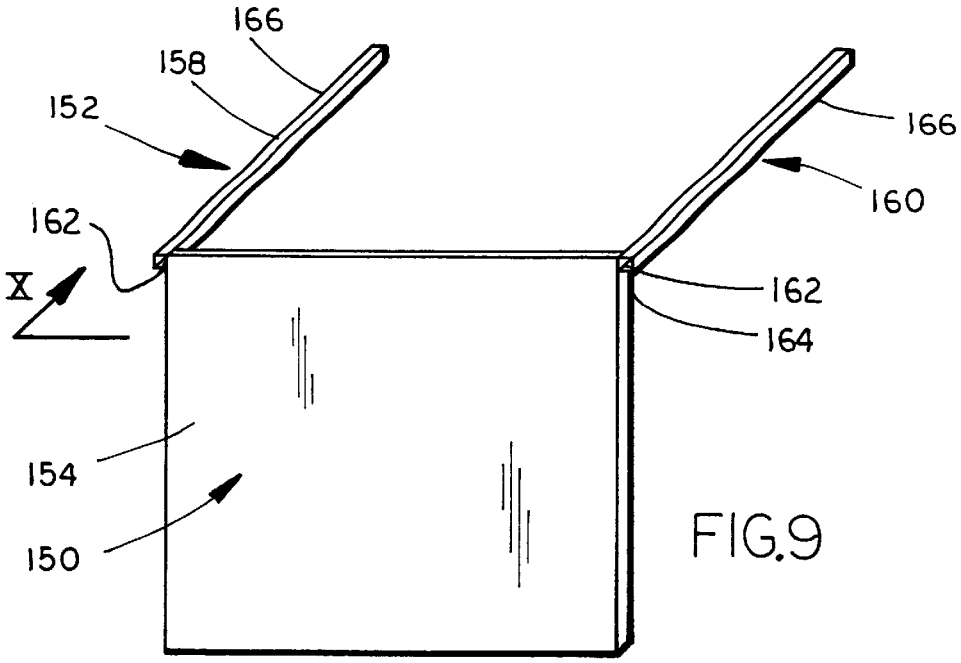
FIG. 9 is a perspective view of the cover and mounting hardware of FIG. 7.

As best seen in FIG. 9, mounting hardware 152 comprises a pair of spaced apart rails 158 and 160. Rails 158 and 160 are mounted to upper frame members 118 and 122 preferably inwardly of outer surfaces 118*a*, 118*b*, and 122*a*, 122*b* of frame members 118 and 122, respectively, in the space between frame 114 and flexible frame 140. Furthermore, when cover 150 is in its closed position, it is generally flush or recessed with respect to the outer surface of rack 114 so that when rack 110 is moved or stacked for storage, both cover 150 and its mounting hardware 152 are protected from contact with the respective frame members of other rack assemblies or the handling equipment and, therefore, are protected from damage.

Figure 10:
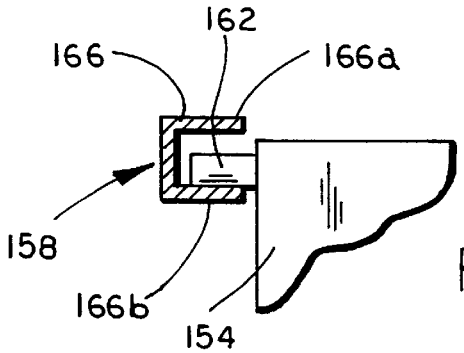
FIG. 10 is an enlarged view of the connection between the cover and the mounting hardware of FIG. 9.
Figure 8:
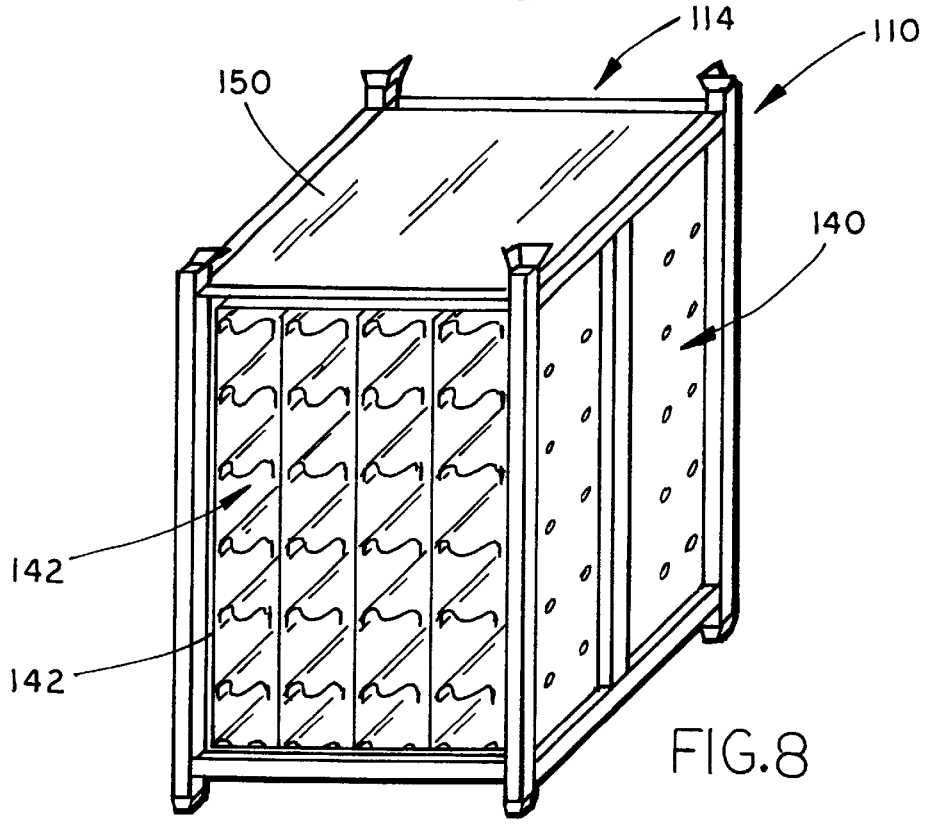
FIG. 8 is a perspective view of the rack assembly of FIG. 7 illustrating the cover in a retracted position.

As best understood from FIGS. 9 and 10, cover 150 includes a pair of guide members such as pins 162 and 164 which suspend cover 150 from rails 158 and 160. In the illustrated embodiment, rails 158 and 160 comprise channel-shaped members 166, with upper and lower flanges 166*a* and 166*b* which are spaced apart sufficiently to permit cover 150 to slide and nest in the respective rails 158, 160 when cover 150 is pivoted from a vertical position as shown in FIG. 9 to a generally horizontal position as shown in FIG. 8. In this manner, cover 150 may be manually pivoted about pins 162 and then manually inserted into rails 158 and 160 to its open position within frame 114. Though mechanical drive mechanisms may be incorporated into frame 14, it is preferable that these mounted mechanisms are manually operated to simplify the construction and minimize the weight of rack 110.

In addition, as noted above, cover 150 may comprise a pair of hinged panels which are interconnected by hinge 168 (as shown in phantom in FIG. 7). In this manner, a portion of cover 150 may be moved to a retracted position within frame 114 while the other portion of cover 150 may remain in a closed position protecting, for example, components supported on an upper group of shelves.

Figure 11:
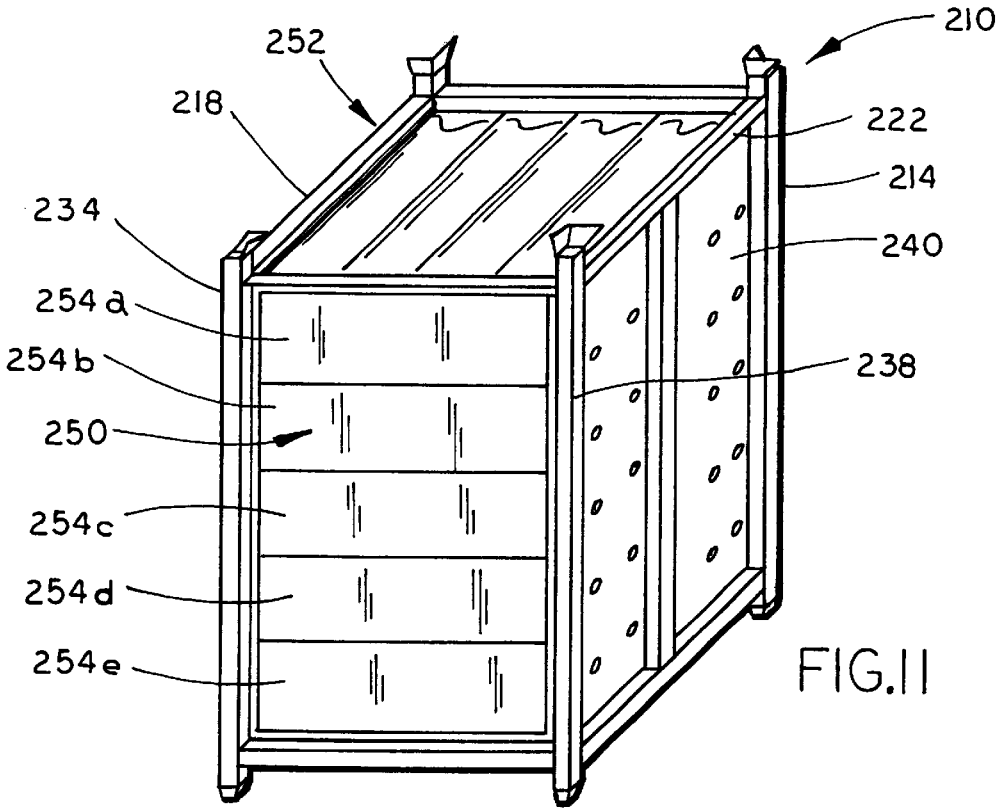
FIG. 11 is a perspective view of a third embodiment of a rack assembly incorporating a second embodiment of a retractable cover of the present invention.

As best seen in FIG. 11, a third embodiment of an industrial component rack 210 is illustrated. Rack 210 includes a frame 214 and a collapsible frame assembly 240 similar to the previous embodiments. For further details of frame 214 and frame assembly 240, reference is made to the previous embodiments. In the illustrated embodiment, rack 210 includes a cover 250 with a plurality of hinged panels 254*a*, 254*b*, 254*c*, 254*d*, and 254*e*.

Figure 12:
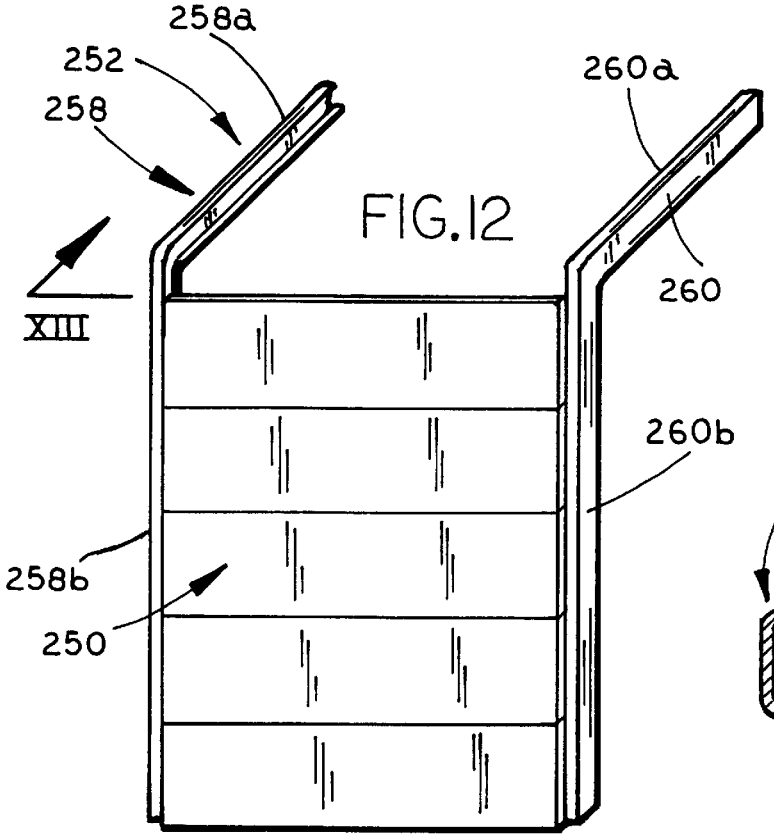
FIG. 12 is a perspective view of the cover of FIG. 11 illustrating the cover and mounting hardware.

As best seen in FIG. 12, mounting hardware 252 includes a pair of rails 258 and 260 which are generally inverted L-shaped rails having an upper portion 258*a*, 260*a* for mounting to upper frame members 218 and 222, respectively, and a lower portions 258*b,* 260*b* for mounting to vertical frame members 234 and 238, respectively. Upper portions 258*a,* 260*a* provide a retracted position for cover 250 within frame 214, while lower portions 258*b,* 260*b* provide for a closed position in which the articles supported in collapsible frame 240 are protected from debris and potential contact with equipment. Additionally, when cover 250 is moved to its closed position, cover also provides a physical barrier to prevent 25 components from falling out of frame assembly 240 should rack 210 be tilted during handling.

Figure 13:
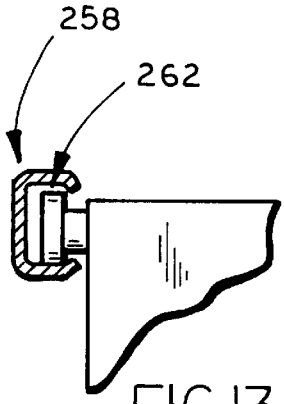
FIG. 13 is an enlarged view of the connection between the cover and the mounting hardware of FIG. 12.

Referring to FIG. 13, preferably each panel segment 254*a,* 254*b,* 254*c,* 254*d,* and 254*e* includes a guide member 262 such as bearing assembly, including for example a wheel, which respectively engage rails 258, 260 so that cover 250 may be moved between its closed position shown in FIG. 12 and an open position in which cover is fully retracted within frame 214 similar to cover 150. Optionally, covers 150 and 250 may be formed from a clear plastic material to provide greater visibility of the parts contained in the collapsible frame. Also, covers 150, 250 may be formed from a plastic frame with clear plastic sheeting extending over the frame, or clear corrugated plastic panels. In addition, the mounting mechanisms may include rollers, bearings, linear guides or the like. It should be understood that covers 150, 250 provide protection to the components in the frame assembly from airborne debris when the covers are moved to their closed position but are retractable into their respective racks when access to the components is needed. Since these covers are retracted into their racks, the covers are not subject to the wear and tear associated with conventional covers heretofore used in industrial racks.

Figure 14:
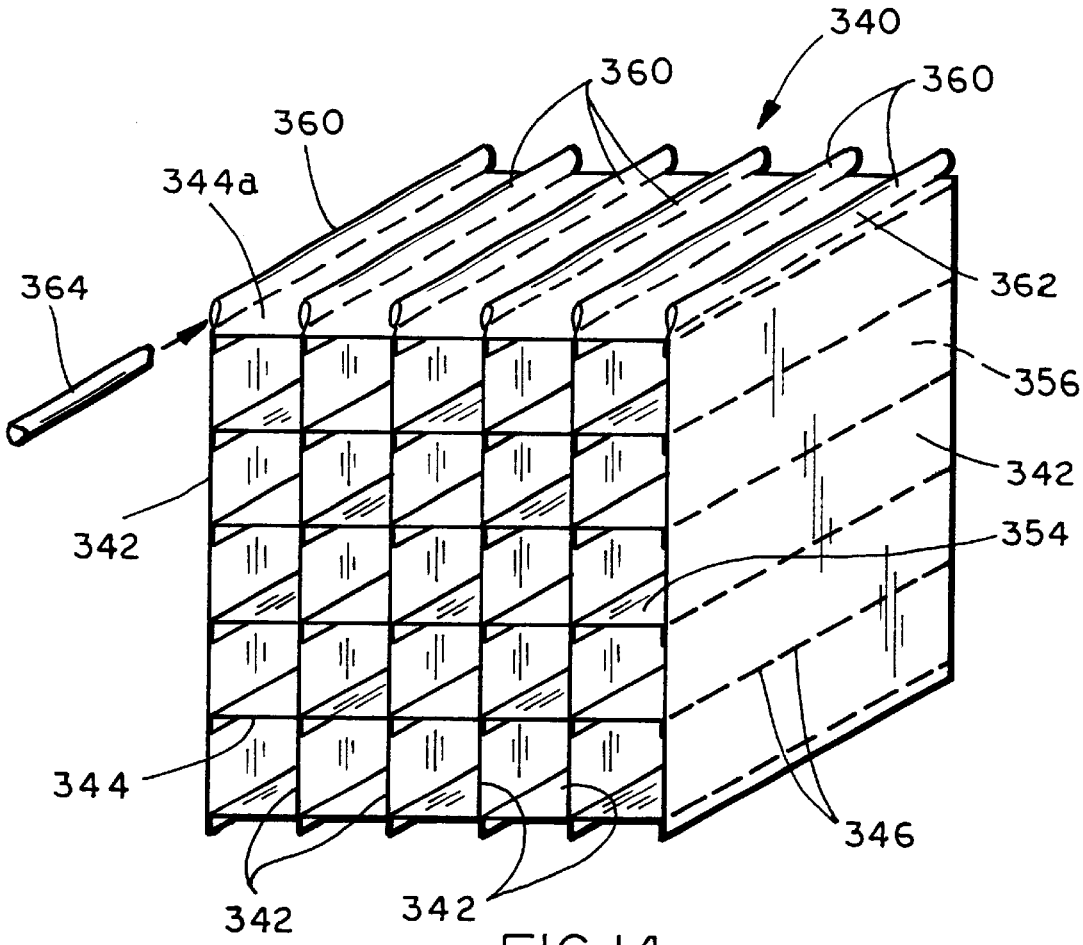
FIG. 14 is a perspective view of another flexible frame of the present invention.
Figure 15:
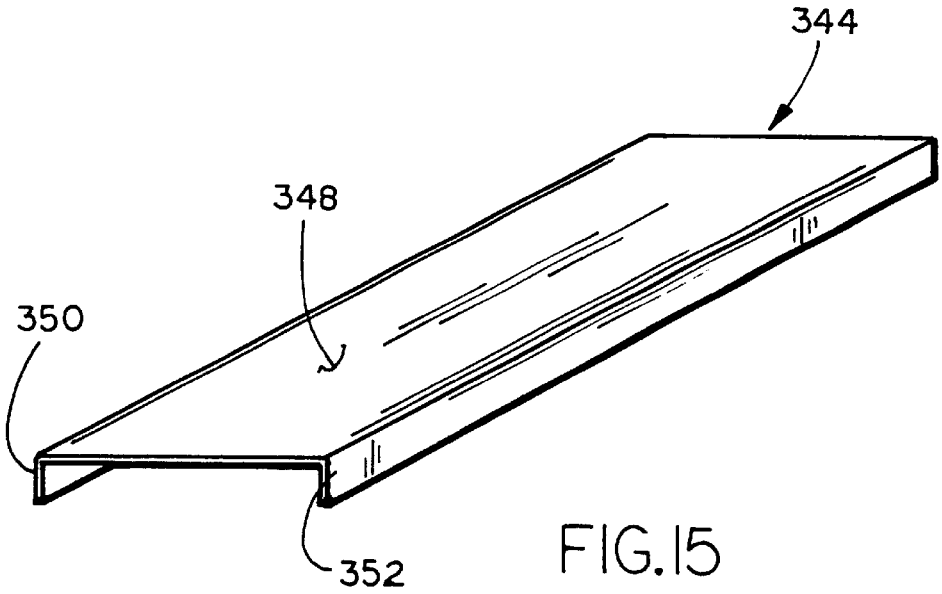
FIG. 15 is an enlarged perspective view of one of the shelf elements of the frame of FIG. 14.

Referring to FIG. 14, a second embodiment 340 of the collapsible frame of the present invention is illustrated. Collapsible frame 340 includes a plurality of side members 342 and a plurality of shelf elements 344. Each shelf element 344 is mounted between a respective pair of side frame members and is secured thereto by a plurality of fasteners 346, such as staples, rivets or the like. Referring to FIG. 15, each shelf element 344 includes an upper generally planar support surface 348, for supporting a component, and a pair of downwardly projecting flanges 350 and 352 which are respectively secured to side members 342 by fasteners 346. For further details of an optional method of assembly of collapsible frame 340, reference is made herein to co-pending U.S. Pat. application Ser. No. 09/838,836, entitled APPARATUS FOR MANUFACTURING INDUSTRIAL COMPONENT HOLDER ASSEMBLIES, filed Apr. 20, 2001, by Calvin J. Kortman, Mark A. Kortman, and Joyce E. Kortman.

In preferred form, side members 342 comprise flexible panels, such as fabric or material panels, including, for example canvas, vinyl, or the like. As best seen from FIG. 14, it is best understood from FIG. 14, each end 354 and 356 of shelf element 344 is open to provide access to components supported in collapsible frame 340 from either end of frame 340. In this manner, when flexible frame 340 is mounted in a rack, such as rack 14, 114, or rack 314 (FIG. 16) components supporting flexible frame 340 are easily accessible from both sides of the rack.

Each shelf element 344 preferably comprises a substantially rigid but light weight panel, such as a plastic panel, including a corrugated plastic panel. Thus, when side members 342 are fully separated and spaced at the maximum extended positions, shelf elements 344 lay in a generally horizontal plane to provide support for a plurality of components. In the illustrated embodiment, shelf elements 344 are arranged in a plurality of rows and columns. However, it can be appreciated that shelf elements 344 may be arranged so that frame 340 includes a single column or a single row of shelves.

Collapsible frame 340 is mounted to a rack, such as rack 14, 114, 314 by a plurality of support mounts 360 which are mounted to upper shelf elements 344*a*. Preferably, support mounts 360 are mounted at the juncture of each shelf element 346*a* and side members 342 to limit the bending of shelf element 344*a*. In the illustrated embodiment, support mounts 360 comprise continuous tubular members 362; however, it can be appreciated, that supports 360 may comprise a plurality of discrete shorter, spaced tubular members which are aligned to receive support rods 364 from the respective rack in which collapsible frame 340 is mounted. Support rods 364 preferably rest in respective rod supports or support mounts provided on the respective rack, such as on the upper horizontal frame members of the rack. In this manner, rod supports 364 may be lifted off the rack frame and then removed from the tubular support 360 so that collapsible frame 340 may be removed from the rack frame.

Figure 16:
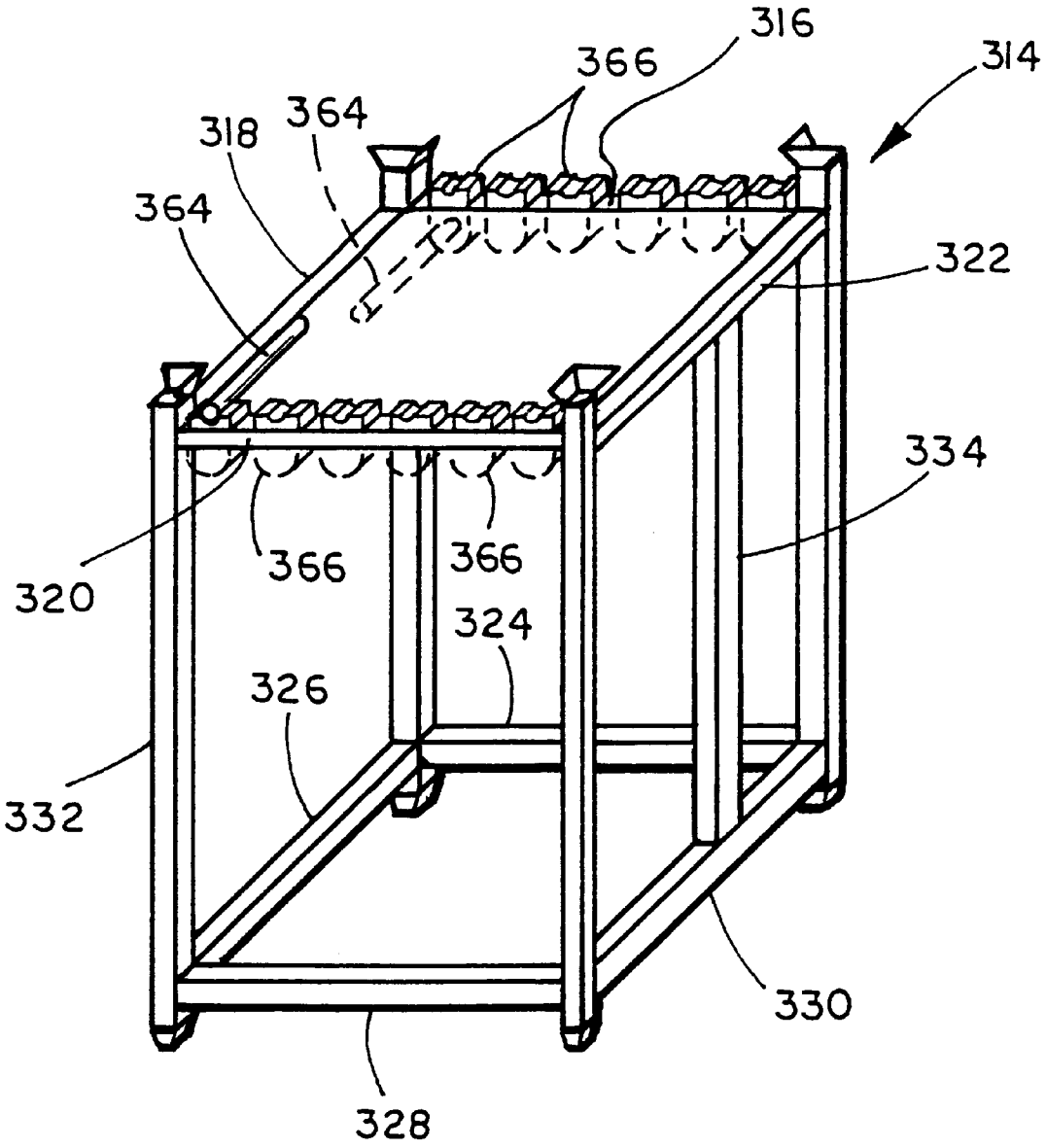
FIG. 16 is a perspective view of a rigid frame in which the flexible frame of FIG. 14 can be mounted.

For example, referring to FIG. 16, rigid rack frame 314 includes a plurality of upper horizontal members 316, 318, 320 and 322 and a plurality of lower horizontal members 324, 326, 328, and 330, which are interconnected by vertical members 332. Optional intermediate members, such as vertical members 334 may be provided to stiffen frame 314, may also be provided. As best seen in FIG. 16, support mounts 366 are shown mounted to an upper surface of upper horizontal members 316 and 320. It should be understood, that support mounts 366 may be similarly mounted (as shown in phantom) to the lower surface of horizontal members 316 and 320. Similar to the previous embodiments, components of frame 314 may be interconnected by welding or fastening, as would be understood by those skilled in the art.

While several forms of the invention have been shown and described, other forms will now be apparent to those skilled in the art. For example, frames 14, 114, and 214 may include intermediate vertical supporting frame members. In addition, when a cover is used, the collapsible frame assemblies may be fastened to the intermediate vertical members provided on the frames. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A rack for holding industrial components, said rack comprising:

a rigid frame, said rigid frame having a plurality of upper horizontal members and a plurality of lower horizontal members interconnected by a plurality of vertical members to thereby form an open frame, an upper portion of said rigid frame including a guide member, said rack comprising a first rack, and said guide member for guiding and providing lateral support to a second rack which is stacked on top of said first rack; and a collapsible frame positionable in said rigid frame, said collapsible frame being supported by said rigid frame and being adapted to support a plurality of industrial components in a vertically spaced arrangement with the industrial components being accessible through at least one open side of said rigid frame, said collapsible frame including a plurality of side members and a plurality of shelf elements extending between respective side members, said side members comprising flexible numbers, said shelf elements comprising substantially rigid shelf elements, wherein said side members fold when collapsible frame is the collapsed.

2. The rack according to claim 1, wherein said flexible members comprise fabric panels.

3. The rack according to claim 1, wherein said shelf elements are arranged in a plurality of rows and columns.

4. The rack according to claim 3, wherein said shelf elements comprise substantially rigid shelf elements.

5. The rack according to claim 1, wherein said shelf elements comprise plastic panels.

6. The rack according to claim 5, wherein said plastic panels comprise corrugated plastic panels.

7. The rack according to claim 5, wherein said shelf elements are secured to said respective side members by a plurality of fasteners.

8. The rack according to claim 7, wherein said fasteners comprise staples.

9. A rack for holding industrial components, said rack comprising:

a rigid frame having a plurality of upper horizontal members and a plurality of lower horizontal members interconnected by a plurality of vertical members to thereby form an open frame, and said rigid frame including a plurality of support mounts;

a flexible frame having a plurality of support surfaces for supporting in said plurality of industrial components, said flexible frame being removably positioned in said rigid frame; and a plurality of supports suspending said flexible frame in said rigid frame, said support mounts receiving said supports, and said support mounts being mounted to said upper members, wherein said support mounts are mounted to a lower surface of said upper horizontal members.

10. The rack according to claim 9, wherein said supports comprise removable supports.

11. The rack according to claim 9, wherein said support mounts comprise tubular members, and said supports extend through said tubular members to thereby support said flexible frame in said rigid frame.

12. The rack according to claim 9, wherein said supports comprise rods.

13. A rack for holding industrial components, said rack comprising:

a rigid frame having at least one open side and including a plurality of guide members, said rack comprising a first rack, and said guide members providing a guide for and lateral support to a second rack which is stacked on top of said first rack; and a collapsible frame positionable in said rigid frame through said open side, said collapsible frame including a plurality of flexible side members and a plurality of substantially rigid shelf elements extending between respective side members of said plurality of flexible side members, and said shelf elements providing support for a plurality of industrial components and being accessible through said open side.

14. The rack according to claim 13, wherein said side members comprise fabric panels.

15. The rack according to claim 14, wherein said shelf elements comprise plastic panels.

16. The rack according to claim 15, wherein said plastic panels comprise corrugated plastic panels.

17. The rack according to claim 15, wherein said plastic panels are secured to said respective side members by a plurality of fasteners.

18. The rack according to claim 17, wherein said fasteners comprise staples.

19. A rack for holding industrial components, said rack comprising:

a rigid frame having a plurality of upper horizontal members and a plurality of lower horizontal members interconnected by a plurality of vertical members to thereby form an open frame, an upper portion of said rigid frame including a guide member, said rack comprising a first rack, and said guide member for guiding and providing lateral support to a second rack stacked on said first rack;

a flexible frame having a plurality of support surfaces for supporting a plurality of industrial components, said flexible frame being removably positioned in said rigid frame; and a plurality of supports suspending said flexible frame in said rigid frame, said support mounts, receiving said supports, and said support mounts being mounted to upper horizontal members.

20. The rack according to claim 19, wherein said support mounts comprise tubular members, and said supports extend through said tubular members to thereby support said flexible frame in said rigid frame.

21. The rack according to claim 20, wherein said supports comprise rods.

* * * * *

UNITED STATES PATENT AND TRADEMARK OFFICE

CERTIFICATE OF CORRECTION

PATENT NO. : 6,601,928 B1 
APPLICATION NO. : 09/838985
DATED : August 5, 2003
INVENTOR(S) : Calvin J. Kortman, Mark A. Kortman and Joyce E. Kortman It is certified that error appears in the above-identified patent and that said Letters Patent is hereby corrected as shown below:

Column 2:
Line 66, "tedescription" should be --the description--.

Column 7:
Line 10, Delete --25-- after "prevent".

Column 9:
Line 6, Claim 1, Insert --the-- after "when".
Line 6, Claim 1, Delete --the-- after "is".

Column 10:
Line 38, Claim 19, Delete --said-- after "frame,".
Line 38, Claim 19, Delete --,-- after "mounts".
Line 40, Claim 19, Insert --said-- after "to".

Signed and Sealed this

Twenty-ninth Day of August, 2006

JON W. DUDAS
*Director of the United States Patent and Trademark Office*